US006407366B2

(12) United States Patent
Yoshimura

(10) Patent No.: US 6,407,366 B2
(45) Date of Patent: Jun. 18, 2002

(54) IMAGE HEATING APPARATUS HAVING A PLURALITY OF HEAT GENERATING ELEMENTS

(75) Inventor: Shotaro Yoshimura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/799,061

(22) Filed: Mar. 6, 2001

(30) Foreign Application Priority Data

Mar. 7, 2000 (JP) ..... 2000-067178

(51) Int. Cl.[7] ..... G03G 15/20; H05B 1/02

(52) U.S. Cl. ..... 219/216; 219/508; 219/519; 399/69

(58) Field of Search ..... 219/216, 469–471, 219/508, 519; 399/69, 329

(56) References Cited

U.S. PATENT DOCUMENTS 5,229,577 A * 7/1993 Matsuura et al. ..... 219/216
5,350,900 A * 9/1994 Inage et al. ..... 219/508
5,918,087 A * 6/1999 Kimura et al. ..... 399/69
5,994,671 A * 11/1999 Sukuki et al. ..... 219/216
6,084,208 A * 7/2000 Okuda et al. ..... 219/216

FOREIGN PATENT DOCUMENTS

JP 57-67970 * 4/1982
JP 6-348172 12/1994

* cited by examiner

*Primary Examiner*—Joseph Pelham
(74) *Attorney, Agent, or Firm*—Fitzpatrick, Cella, Harper & Scinto

(57) ABSTRACT

Conventionally, a thermal fixing apparatus contained in an image forming apparatus has a heater like a halogen heater or a film-heating type heater. Generally, the heater comprises a plurality of heat generating elements connected to an AC power supply. Since the thermal fixing apparatus has a plural of heat generating elements, it needs a switching control elements corresponding to the number of heaters. The switching control elements causes a need for being increased in size so as to cope with energizing of large current of driving the heater. For the purpose of solving the above problem, an apparatus requiring only a small number of semiconductor switching elements is provided.

4 Claims, 8 Drawing Sheets

IMAGE HEATING APPARATUS HAVING A PLURALITY OF HEAT GENERATING ELEMENTS

BACKGROUND OF THE INVENTION

1. Field of the Invention

The present invention relates to an image heating apparatus preferably for use as a fixing device in a copying machine, a laser beam printer or the like, and particularly to an image heating apparatus having a plurality of heat generating elements therein.

2. Related Background Art

Conventionally a thermal fixing apparatus contained in this type of image forming apparatus fixes an unfixed image (toner image) formed on a recording sheet by an electrophotographic process or other image forming means into the recording sheet, and there are well known types such as a thermal-roller type fixing apparatus having a halogen heater as a heat source or a film-heating type thermal fixing apparatus having a ceramic flexible heating sheet heater as a heat source.

FIG. 8 shows an example of a general heater driver circuit adopted to this type of thermal fixing apparatus.

As shown in FIG. 8, a heater 803 generally comprising a plurality of heat generating elements is connected to a commercial AC power supply 801 via a triac or other switching control elements 804 and 816 and power is supplied from this AC power supply 801. The heater 803 is provided with a temperature detecting element, for example, a thermistor 814, a temperature of the heater 803 is detected by the temperature detecting element 814, a control circuit (power supply instruction means) 812 is turns on or off the switching control elements 804 and 816, by which a power supply to the heater 803 is turned on or off to control a temperature of the thermal fixing apparatus to a certain temperature of a target.

The on or off control of the power supply to the heater 803 is performed by a wave number control or a phase control of the commercial power supply 801.

The heater 803 has two generating elements, each having a length according to a width of a recording sheet, and therefore two heat generating elements are not concurrently energized. Filters 811 and 823 are provided to remove switching noises generated from the switching control elements 804 and 816 by turning on or off the heater 803.

The conventional apparatus set forth in the above requires switching control elements for controlling the heater by the number of the heat generating elements of the heater. In this condition, the switching control elements 804 and 816 for supplying power must turn on or off a power supply for large current to the heater 803, thereby causing a need for being increased in size so as to cope with energizing of large current for driving the heater. This increase in size of the elements causes an increase of an amount of heat generated from the elements at switching or an increase of noises generated by the switching operation. Therefore, it is further required to take countermeasures against heat generation caused by the switching operation or to provide a filter for absorbing the noises.

SUMMARY OF THE INVENTION

In view of these problems, the present invention has been provided, and therefore it is an object of the present invention to provide an image heating apparatus requiring only a small number of semiconductor switching elements in spite of having a plurality of heat generating elements.

It is another object of the present invention to provide an image heating apparatus, comprising:

a heating member having a first heat generating element and a second heat generating element;

relay means for relaying between a power supply and said heating member, said relay means connecting either said first heat generating element or said second heat generating element to the power supply;

switching means arranged between the power supply and said heating member; and control means for controlling said switching means so that a temperature of said heating member is maintained at a set temperature.

Other objects of the present invention will be apparent from the following detailed description by referring to the accompanying drawings.

DETAILED DESCRIPTION OF THE PREFERRED EMBODIMENTS

FIRST EMBODIMENT

An image forming apparatus of the present invention will be described below according to a first embodiment applied to a laser beam printer using an electrophotographic process.

Figure 1:
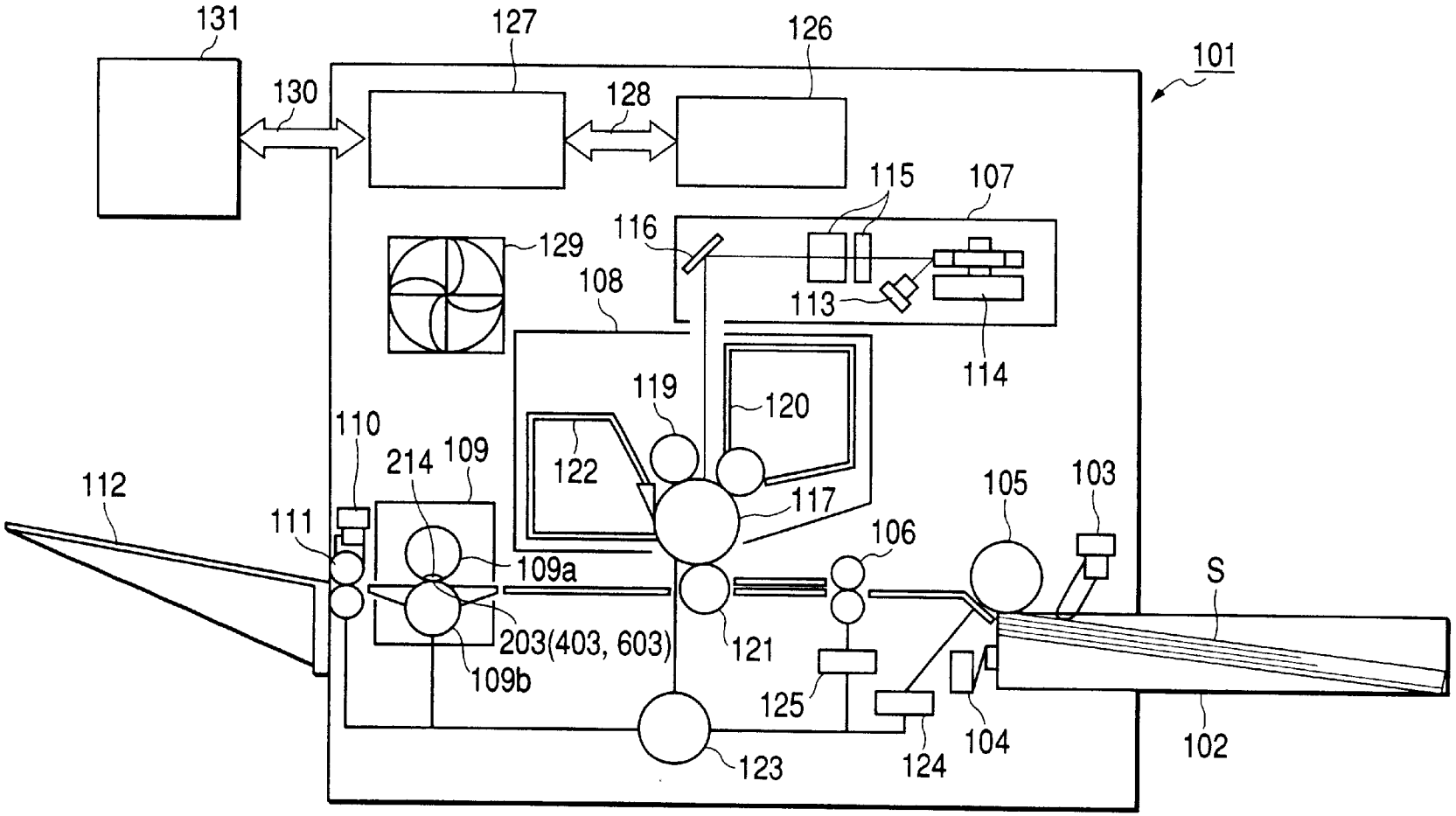
FIG. 1 is a sectional side elevation view schematically showing a main internal configuration of an image forming apparatus according to a first embodiment of the present invention.

Referring to FIG. 1, there is shown a sectional side elevation view schematically showing a main internal configuration of the laser beam printer according to the first embodiment of the present invention.

A laser beam printer 101 is provided with a cassette 102 for storing recording sheets S, a cassette presence/absence sensor 103 for detecting a presence or an absence of the recording sheets S in the cassette 102, a cassette size sensor 104 for detecting a size of the recording sheets S in the cassette 102 (comprising a plurality of microswitches), and a feed roller 105 for feeding the recording sheets S from the cassette 102.

In a downstream of the feed roller 105 there is provided a registration roller pair 106 for synchronously conveying the recording sheets S. Additionally in a downstream of the registration roller pair 106 there is provided an image forming part 108 for forming a toner image on the recording sheet S on the basis of a laser light from a laser scanner part 107.

Furthermore, in a downstream of the image forming part 108 there is provided a thermal fixing apparatus 109 as a thermal fixing means for thermally fixing the toner image formed on the recording sheet S, and in a downstream of the thermal fixing apparatus 109 there are provided a sheet discharge sensor 110 for detecting a conveyance condition of a sheet discharging part, a discharging roller 111 for discharging the recording sheet S, and a stacking tray 112 to be stacked with the completed recording sheets S.

The laser scanner 107 comprises a laser unit 113 for emitting a laser light modulated on the basis of an image signal (image signal VDO) transmitted from an external device 128 described later, a polygon motor 114 for scanning the laser light from the laser unit 113 on a photosensitive drum 117 described later, an imaging lens 115, and a folded mirror 116.

The laser beam printer 101 comprises a photosensitive drum 117, a primary charging roller 119, a developing unit 120, a transfer charging roller 121, a cleaner 122 and the like needed for a known electrophotographic process, and the thermal fixing apparatus 109 comprises a fixing film 109*a*, a pressure roller 109*b*, a ceramic heater 203 arranged inside the fixing film 109*a*, and a thermistor temperature detecting element (hereinafter referred to as a temperature detecting element) 214 as temperature detecting means for detecting a surface temperature of the ceramic heater.

A main motor 123 supplies a driving force to the feed roller 105 via a feed roller clutch 124 and to the registration roller pair 106 via a registration roller 125 and further it supplies a driving force to respective units in the image forming part 108 including the photosensitive drum 117, the thermal fixing apparatus 109, and the discharging roller 111.

An engine controller 126 controls the laser scanner part 107 and the image forming part 108 as well as controlling the electrophotographic process with the thermal fixing apparatus 109 and the conveyance of the recording sheets S in the laser beam printer 101.

A video controller 127, which is connected to an external device 131 such as a personal computer via a general-purpose interface (Centronics, RS232C, etc.) 130, expands image information transmitted from the general-purpose interface to bit data and transmits the bit data as a VDO signal to the engine controller 126.

Figure 2:
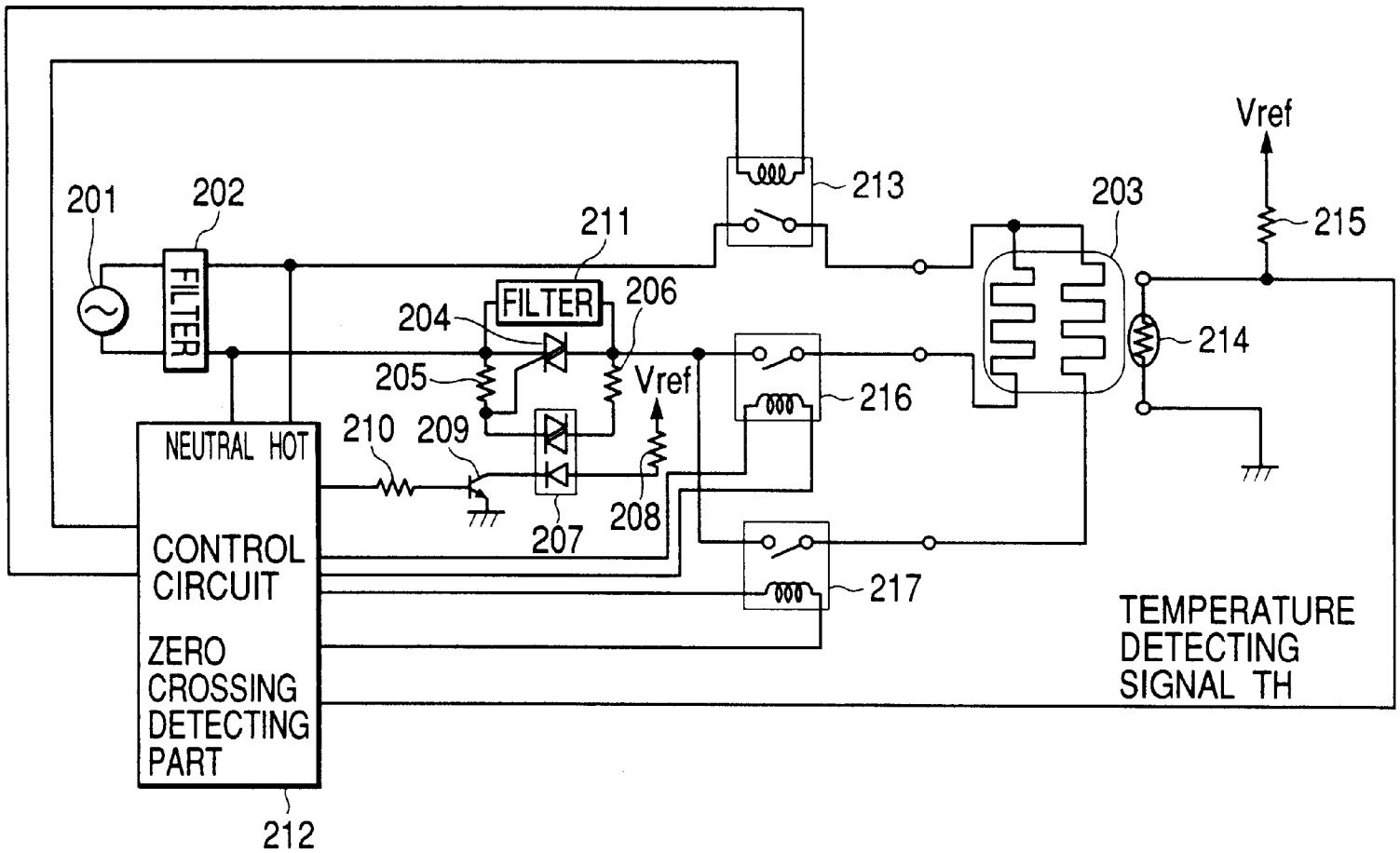
FIG. 2 is a diagram showing a circuitry of control and driver circuits of a thermal fixing apparatus according to the first embodiment.

Referring to FIG. 2, there is shown driver and control circuit of the ceramic heater 203.

A commercial AC power supply 201 for supplying power is connected to the image forming apparatus 101 (See FIG. 1).

The image forming apparatus 101 (See FIG. 1) causes the ceramic heater 203 to generate heat when the AC power supply 201 supplies power to the ceramic heater 203 via an AC filter 202.

Figure 3:
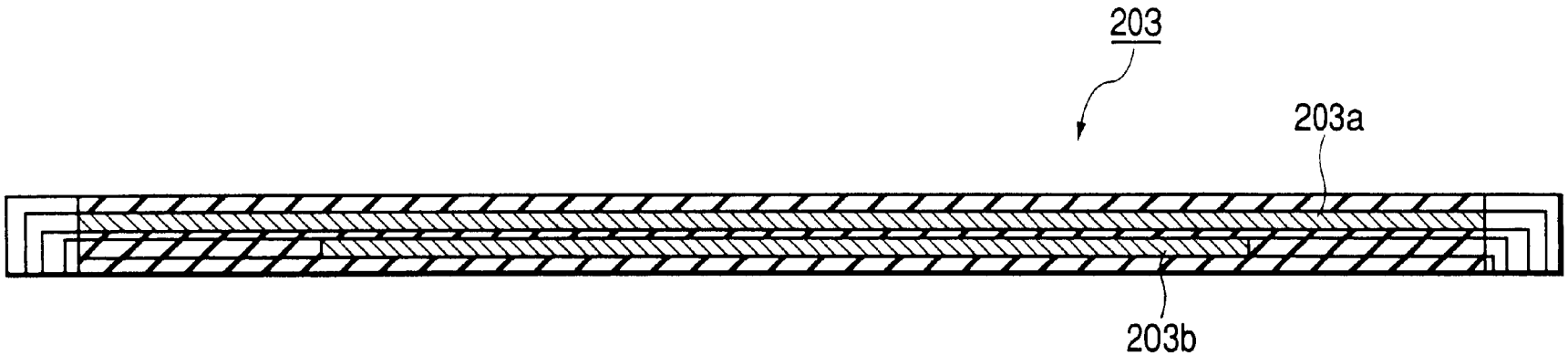
FIG. 3 is a schematic view showing a ceramic heater according to the first embodiment with a heat generating element contained therein.

The ceramic heater 203 contains two heat generating elements 203*a* and 203*b* as shown in an enlarged view in FIG. 3, with energizing appropriately switched between the heat generating elements in the heater according to a width of a recording sheet S for printing. Power supply to the ceramic heater 203 (the heat generating elements 203*a* and 203*b*) is performed by energizing or shutting down a triac 204. Resistances 205 and 206 are bias resistances for the triac 204 and a photo triac coupler 207 is a device for securing a creepage distance for insulation between the primary and secondary resistances. A relay 213 is energized in response to a signal from a control circuit 212. Relays 216 and 217 serve as switches (energizing heat generating element switching means) for switching a heat generating element for generating heat (for energizing) of the heat generating elements 203 and 203*b* contained in the ceramic heater 203 and they are turned on or off by the control circuit 212 according to a width of a recording sheet S. The triac 204 is turned on by energizing light-emitting diodes of the photo triac coupler 207. A resistance 208 is used for restraining current of the photo triac coupler 207 and turned on or off by a transistor 209. The transistor 209 is connected to the control circuit 212 via a resistance 210 and operates in response to an ON signal from the control circuit 212. A filter 211 is arranged to restrain noises generated when the ceramic heater 203 is turned on or off.

The AC power supply 201 is inputted to a zero-crossing detecting part of the control circuit 212 via the AC filter 202. The zero-crossing detecting part of the control circuit 212 notifies the inside of the control circuit 212 that the AC power supply 201 is at a voltage of a certain threshold value or lower by means of a pulse signal. Hereinafter, this signal transmitted by the zero-crossing detecting part of the control circuit 212 is referred to as ZEROX signal.

The control circuit 212 detects an edge of a pulse of the ZEROX signal and turns on or off the triac 204 by a phase control or a wave number control.

A temperature detected by a temperature detecting element 214 (See FIG. 1, too) is detected as a shunt voltage between a resistance 215 and the temperature detecting element 214 and A/D-inputted to the control circuit 212 as a TH signal.

In other words, a temperature of the ceramic heater 203 is monitored as a TH signal (digital signal) in the control circuit 212. Then, it is compared with a preset temperature of the ceramic heater 203 set inside the control circuit 212, by which power to be supplied to the ceramic heater 203 is calculated, the temperature is converted to a phase angle (phase control) or a wave number (wave number control) corresponding to the supplied power, and it is appropriately transmitted as an ON signal to the transistor 209.

Next, a heat generating operation will be described when using two heat generating elements arranged in the ceramic heater 203.

Figure 4:
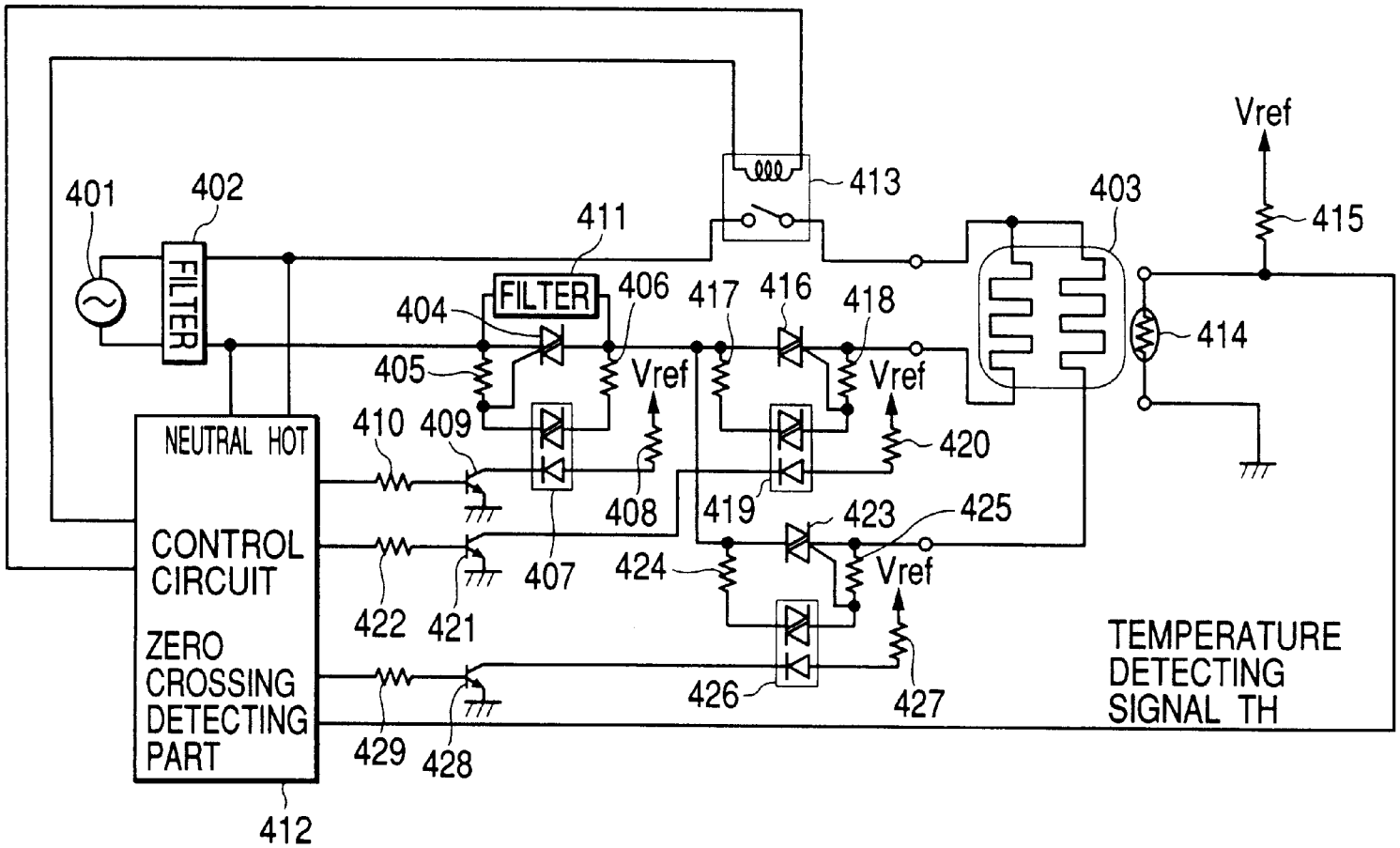
FIG. 4 is a diagram showing a circuitry of control and driver circuits in another example of a thermal fixing apparatus according to the first embodiment.

First, when a printing operation is started, the relay 213 is closed. With this, one of the two heat generating elements in the ceramic heater 203 is selected according to a width of the recording sheet S by closing the relay 216 or the relay 217. The relay 216 and the relay 217 are used for selecting the heat generating element and therefore can be in a type including a relay switch as shown in FIG. 2 or a type including a triac as shown in FIG. 4. It is also possible to use other types of switching means. Furthermore, the relay 216 and the relay 217 are not turned on or off during energizing of the ceramic heater 203, and therefore there is no need for arranging a noise removing means such as the filter 211 nor for making an allowance for a current capacity.

Therefore, the triac 204 (a triac 404 in FIG. 4) is turned on or off while the temperature detecting element 214 is monitored, by which the temperature of the ceramic heater 203 is controlled to be an appropriate value.

Figure 5:
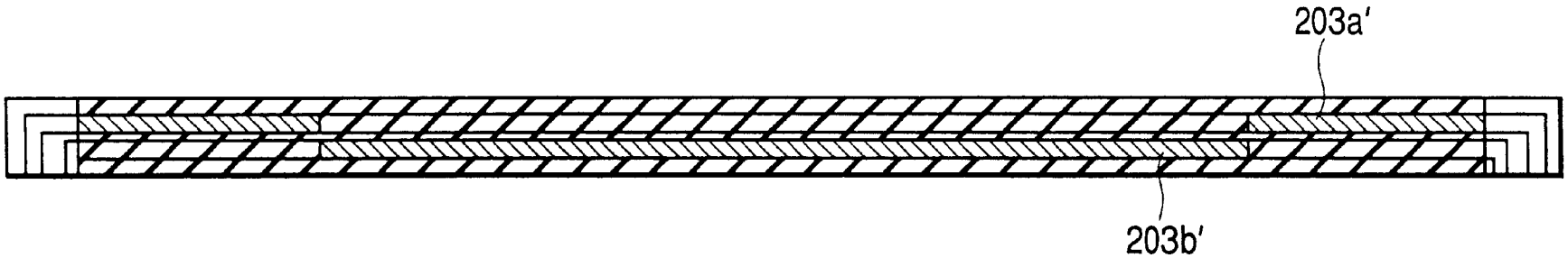
FIG. 5 is a schematic view showing a ceramic heater in another example according to the first embodiment.

In this embodiment, as shown in FIG. 3, the heat generating elements of the ceramic heater indicated by black areas have different lengths, while it is possible to arrange a plurality of heat generating elements having the same length and to arrange respective heat elements as indicated by shaded areas shown in FIG. 5.

In another example shown in FIG. 5, both of the relay 216 and the relay 217 are closed and two heat generating elements 203*a*' and 203*b*' are energized at a time so as to cope with a wide recording sheet. In addition, while two heat generating elements are specified as the number of heat generating elements contained the ceramic heater in this embodiment, it is possible to use three or more heat generating elements.

SECOND EMBODIMENT

Next, a second embodiment in which an image forming apparatus according to the present invention is applied to a laser beam printer will be described below with points different from the first embodiment focused on.

In the laser beam printer according to this embodiment, a basic configuration and a mechanical operation mode in an image formation are almost the same as those of the first embodiment described above, and therefore the overlapped description will be omitted here.

Figure 6:
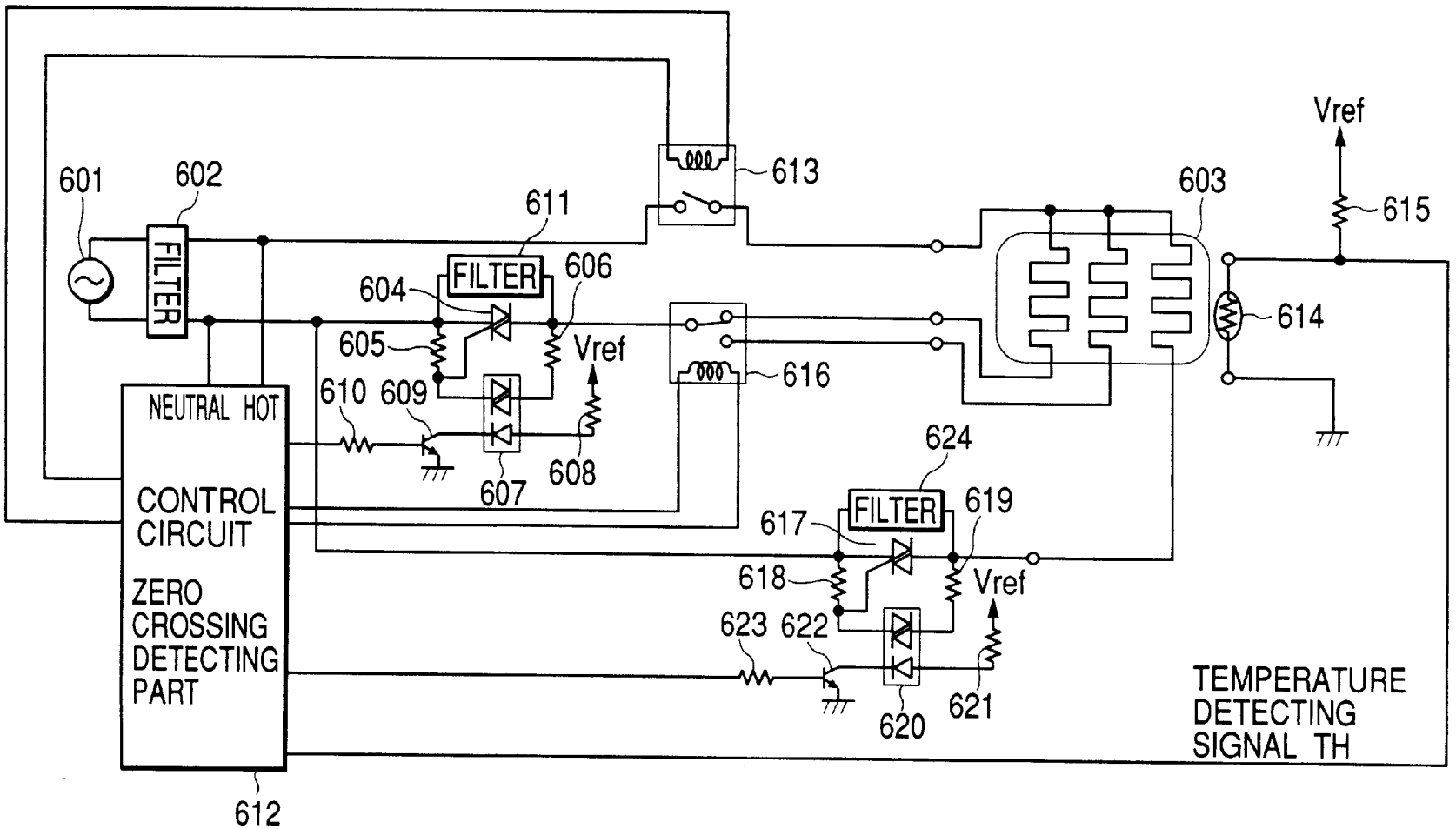
FIG. 6 is a diagram showing a circuitry of control and driver circuits of a thermal fixing apparatus according to a second embodiment of the present invention.

Referring to FIG. 6, there are shown driver and control circuits of a ceramic heater 603 of a thermal fixing apparatus arranged in the laser beam printer of this embodiment.

Figure 7:
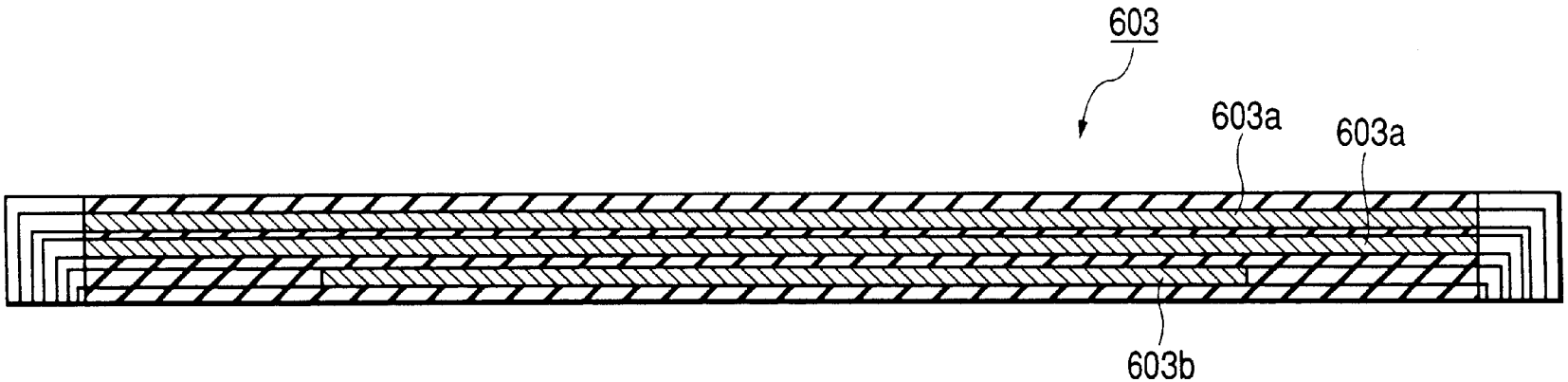
FIG. 7 is a schematic diagram showing a ceramic heater according to the second embodiment with a heat generating element contained therein.
Figure 8:
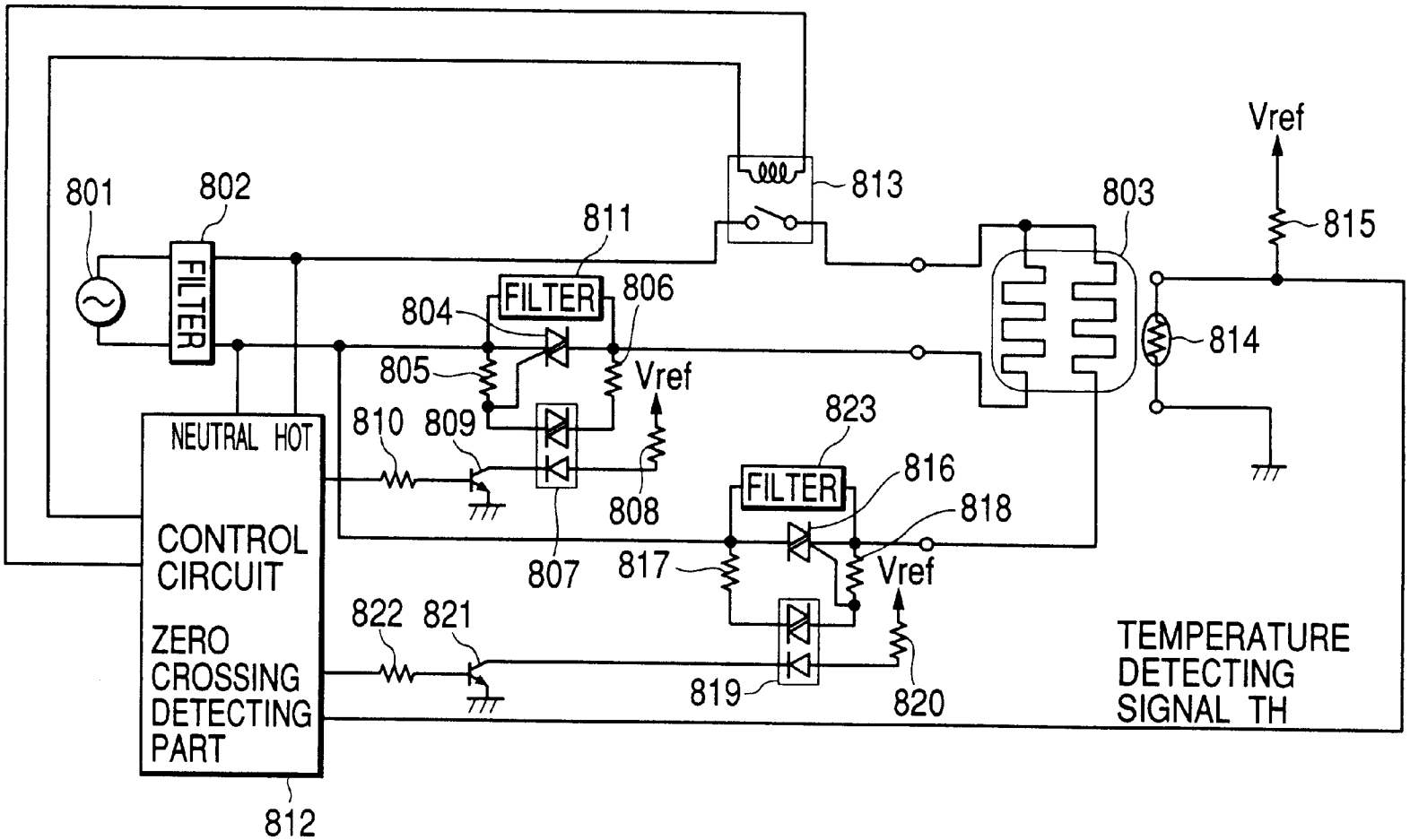
FIG. 8 is a diagram showing a circuitry of control and driver circuits of a conventional thermal fixing apparatus.

The ceramic heater 603 contained in the thermal fixing apparatus according to this embodiment comprises two long heat generating elements 603*a* and a short heat generating element 603*b* as shown in FIG. 7. The two long heat generating elements 603*a* are energized if the recording sheet S is relatively wide. In this condition, a load variation caused by turning on or off the ceramic heater at a temperature control is minimized by an appropriate combination of a control of energizing respective heat generating elements 603*a*. On the other hand, if the recording sheet S is relatively narrow, the heater is controlled so that only the short heat generating element 603*b* is energized. On its control, these two long heat generating elements are not energized concurrently with the short heat generating element.

A relay 616 is a switching means used for a switching operation between one of the two long heat generating elements and the short heat generating element. This relay 616 does not performs the switching operation during energizing of the ceramic heater 603. Therefore, there is no need for securing an excessive current capacity.

When energizing the long heat generating elements for a wide recording sheet, the switching operation of the relay 616 is performed on the basis of an instruction from the control circuit 612. Subsequently a triac 604 and a triac 617 are turned on or off to control the temperature of the ceramic heater 603. At this point, with an appropriate distribution of a power supply control to the two heat generating elements, it becomes possible to reduce an adverse effect to the outside of the printer, particularly flickering, caused by a load variation of the ceramic heater 603.

While two heat generating elements can be selected out of the three heat generating elements in this embodiment, apparently it is also possible to use any selecting type as far as possible, including a plurality of heat generating elements selectable out of a plurality of ones and a single heat generating element selectable out of a plurality of heat generating elements such as, for example, one selectable out of two heat generating elements or some selectable out of three or more heat generating elements for the same control as for this embodiment.

What is claimed is:

1. An image heating apparatus comprising:

a heating member having a plurality of heat generating elements comprising a first heat generating element and a second heat generating element;

selecting means for selecting either said first heat generating element or said second heat generating element;

first switching means arranged between a power supply and said heating member and used for controlling supplying of power to the selected one of said first heat generating element or said second heat generating element; and second switching means arranged between the power supply and said heating member and used for controlling supplying of power to a specific one of said plurality of heat generating elements.

2. An image heating apparatus according to claim 1, wherein at least one of said first and second switching means is a semiconductor element.

3. An image heating apparatus according to claim 2, wherein at least one of said first and second switching means is a TRIAC.

4. An image heating apparatus according to claim 1, wherein said selecting is controlled in accordance with a size of a recording material.

* * * * *

UNITED STATES PATENT AND TRADEMARK OFFICE

CERTIFICATE OF CORRECTION

PATENT NO. : 6,407,366 B2
DATED : June 18, 2002
INVENTOR(S) : Shotaro Yoshimura

It is certified that error appears in the above-identified patent and that said Letters Patent is hereby corrected as shown below:

Title page,
Item [57], ABSTRACT,
Line 5, "plural" should read -- plurality --.
Line 6, "a" should be deleted.
Line 8, "causes" should read -- cause --.

Column 1,
Line 32, "is" should be deleted.

Column 5,
Line 43, "performs" should read -- perform --.

Signed and Sealed this

Seventeenth Day of September, 2002

*Attest:*

*Attesting Officer*

JAMES E. ROGAN
*Director of the United States Patent and Trademark Office*